US005404592A

United States Patent [19]

Jackson

[11] Patent Number: 5,404,592

[45] Date of Patent: Apr. 11, 1995

[54] METHOD FOR CONVERTING LONG SLEEVES TO SHORT SLEEVES

[76] Inventor: Jay D. Jackson, 562 Harperville Rd., Newport News, Va. 23601

[21] Appl. No.: 153,919

[22] Filed: Nov. 17, 1993

[51] Int. Cl.[6] ..... A41B 1/08

[52] U.S. Cl. ..... 2/125; 2/269

[58] Field of Search ..... 2/126, 125, 269, 231, 2/232, 233

[56] References Cited

U.S. PATENT DOCUMENTS

| | | | |
|---|---|---|---|
| 2,420,162 | 5/1947 | Baker | 2/269 |
| 2,446,117 | 7/1948 | Tye | 2/269 |
| 2,480,276 | 8/1949 | Wilkefeld | 2/232 |
| 2,720,656 | 10/1955 | Allan, Jr. | 2/232 |
| 2,860,081 | 11/1958 | Eiken | 2/232 |
| 2,869,138 | 1/1959 | Hankoff | 2/232 |
| 3,137,863 | 6/1964 | Dimpfl | 2/232 |

*Primary Examiner*—Clifford D. Crowder
*Assistant Examiner*—Gloria Hale
*Attorney, Agent, or Firm*—Laurence R. Brown

[57] ABSTRACT

Long sleeved army military battle dress shirts are temporarily converted to short sleeve shirts with uniformly folded, stiffened and shaped lower shirt cuffs disposed above the elbow. The cuffs are neatly shaped about an internally disposed substantially cylindrical plastic film cuff stiffener appliance. For shaping the cuffs, the sleeves are upwardly folded, outer fabric surface inward to provide a lowermost fold near the elbow. The lowermost portion of the folded over sleeve is then folded upward again to leave an uppermost flap at the sleeve end exposed. The cylindrical cuff stiffening appliance is inserted into a fold between shirt fabric layers and retained thereby so that the upper portion of the fabric at the end of the shirt sleeve may be folded back downwardly over the appliance. This exhibits the outer fabric in a neatly folded and shaped short sleeve cuff, which can produce neat, uniform appearance for non-battle use when short sleeves are desired.

4 Claims, 2 Drawing Sheets

METHOD FOR CONVERTING LONG SLEEVES TO SHORT SLEEVES

TECHNICAL FIELD

This invention relates to temporary conversion of long sleeve shirts of the type issued to U. S. Army soldiers to short sleeve shirts. More particularly it relates to folding a long sleeve up over the wearer's elbow to simulate a short sleeve, and removably inserting between layers of folded shirt fabric a rigid cylindrical plastic cuff shaping appliance for metering a uniform cuff length, for retaining the folded sleeve fabric in place and for neatly shaping the cuff.

BACKGROUND ART

Army battle dress uniform shirts are issued with long cuffless sleeves of generally cylindrical configuration for covering and protecting the arms under field conditions. Short sleeved shirts are not issued. Thus, the only way to get regulation short sleeved shirts is to roll up the sleeves of the issued long sleeve shirts. However, it is difficult and tedious to roll sleeves up precisely enough to be uniform, or to pass inspection where both neatness and uniformity in dress attire is demanded.

Accordingly it is an objective of this invention to provide conversion means and methods for temporarily converting long sleeved shirts to short sleeved shirts simply, uniformly and neatly.

DISCLOSURE OF THE INVENTION

Army issued military battle dress uniforms have substantially cylindrical shaped long sleeves for protection of the arm under field conditions. There are no short sleeved shirts issued. Thus, this invention provides for temporarily converting the long sleeve shirts to short sleeve shirts in an expedited manner that provides neatly formed and uniform appearance. A cuff band appliance is provided in the form of a substantially cylindrical thin, high impact, heat resistance plastic film band adapted to encircle a shirt wearer's arm above an elbow. In place the cuff band encircles the arm and is retained in a position above the elbow along a lower portion of an upwardly folded long shirt sleeve. When folded, the shirt sleeve fabric has the inner shirt fabric surface outward. The cuff is inserted into a fold to maintain the shirt sleeve fabric axially and circumferentially in place on the arm above the elbow. The cuff band thus forms a neatly shaped shirt sleeve cuff of uniform shape and dimension. The uppermost sleeve position is folded downwardly over the cuff band to provide the finished short sleeve with the outer fabric surface visible.

The shirt sleeve shortening procedure is started by folding the cylindrical sleeve upwardly when worn on a wearer's arm with the shirt sleeve fabric inside surface-out to extend upwardly on the arm above the elbow. Then a lower portion of the upwardly folded shirt sleeve is again folded. The substantially cylindrical unattached cuff band serves as a shaper and cuff stiffener, holding the short sleeve in place neatly and uniformly during workouts for example. The cuff band encircles the arm above the elbow and is retained in a fold in the shirt sleeve to serve as a form for folding downwardly the uppermost flap portion of the sleeve fabric over the cuff band. Thus, the folded shirt sleeve covers the cuff band with the outside surface of the shirt sleeve displayed so that the decor of the battle dress uniform is maintained in the short shirt sleeve so formed.

The substantially cylindrical cuff band stiffener is formed of a high impact, heat resistant, plastic film having a diameter of the order of four inches (10.2 cm), a height of the order of three inches (7.6 cm), and a thickness of the order of 0.030 inches (0.76 mm). The plastic film sheet material is of the "memory" type that elastically returns to its original shape when physically bent or otherwise deformed out of the original shape. Thus, with an axial slit through the cuff height, the cuff member provides an elastic clamping band that will conform to a range of arm sizes that can be worn comfortably in a functional position for retaining the bottom of the shortened shirt sleeve cuff in place on the arm to position and shape the cuff.

Further objects, features and advantages of the invention will be found throughout the following description, and claims taken together with the accompanying drawings.

BRIEF DESCRIPTION OF THE DRAWINGS

In the accompanying drawings, wherein like reference characters indicate similar features in the various views.

THE PREFERRED EMBODIMENTS

Figure 1:
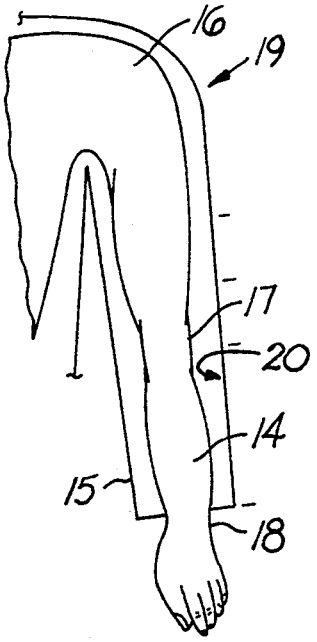
FIG. 1 is a fragmental section view sketch of a person wearing a typical long sleeve shirt provided as a regularly issued army military battle dress uniform.
Figure 6:
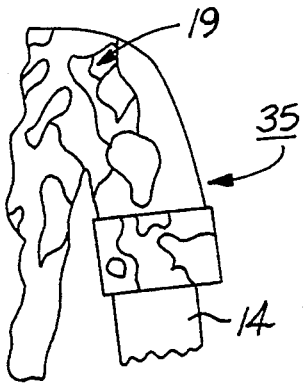
FIG. 6 is a fragmental front view sketch of the temporarily converted short sleeve shirt afforded by this invention.

With reference to FIG. 1, it is seen that the military battle dress uniform has a long generally cylindrical sleeve 15 loosely fitting over the arm 14 and extending from the shoulder 16 past the elbow 17 down to the region of the wrist 18. The outer fabric surface 19 has a camouflage pattern 19 (FIG. 6) and the inside surface 20 is not decorative.

Figure 2:
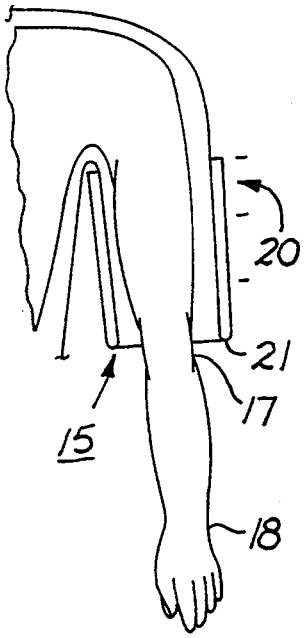
FIG. 2 is a fragmental section view sketch showing the shirt sleeve folded upwardly near the elbow.
Figure 3:
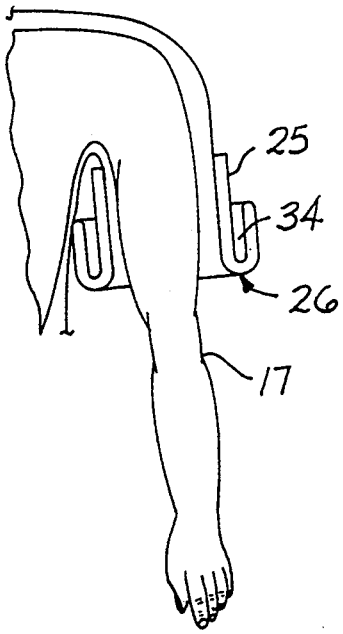
FIG. 3 is a fragmental sketch showing a second upward fold of the lower portion of the folded over shirt sleeve.

The sleeve 15 is folded upward in a first step with a lowermost crease 21 near the elbow 17 as indicated in FIG. 2 to display the inside surface 20 along the outer surface. The folded over flap has enough height to accommodate a second fold step at new crease 34, as illustrated in FIG. 3. Five folds each have a height approximating 20% that permits the uppermost flap position to cover as an outermost layer the four inner layers 26, thus establishing a neat and consistent folding pattern.

Figure 4:
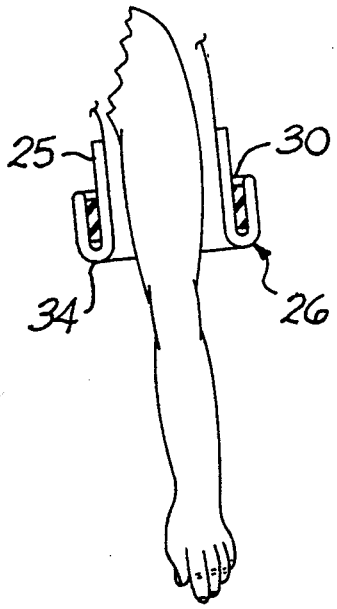
FIG. 4 is a fragmental sketch of the preferred embodiment showing a cuff band inserted in and retained by the shirt fold in the lower portion of the folded-over sleeve.
Figure 7:
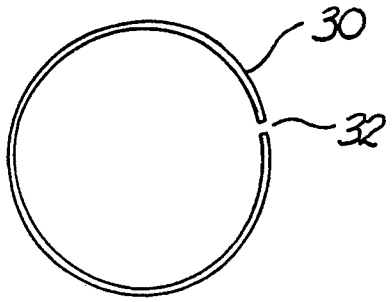
FIG. 7 is a top view of a preferred embodiment of the cuff band that functions as an elastic clamp hugging the arm, better shown in perspective view in FIG. 9.
Figure 9:
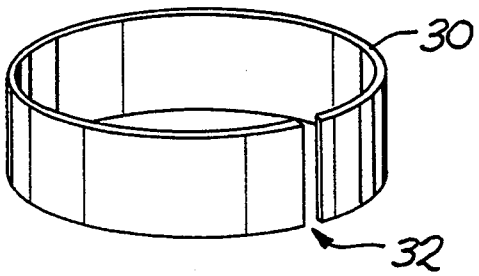
FIG. 9 is a perspective view of a preferred embodiment of the cuff band that functions as an elastic clamp hugging the arm as shown in FIG. 7.

In the FIG. 4 step, a rigid, unattached cuff shaper and stiffener appliance 30 is positioned to encompass the arm and to reside in the fold intermediate the four layers 26. As better seen in FIGS. 7 and 9, the cuff is a cylindrically shaped member formed of a thin film, high impact, heat resistant plastic such as an uncoated polycarbonate available from GE Plastics under the brand name "LEXAN". It is important for uniformity that the height of the cylinder be chosen to produce a consistent cuff length on the short sleeved shirt that results from this invention.

Figure 8:
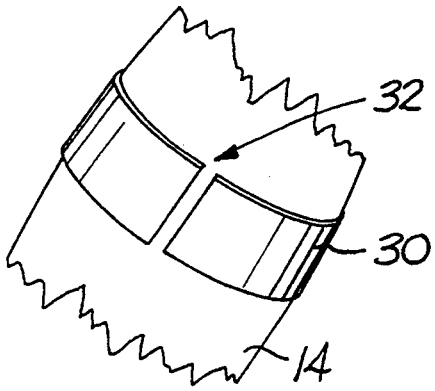
FIG. 8 is a fragmental sketch of the preferred cuff band embodiment afforded by this invention in place on the arm.

Typical dimensions are: cylinder diameter, four inches (10.2 cm); cylinder height, three inches (7.6 cm) and film thickness, 0.030 inch (0.76 mm). Also preferably the cylinder has an axial slit 32 in a plastic film such as polycarbonate that is treated to elastically return to its preferred cylindrical shape. Thus, the cuff member 30 may serve as a comfortable clamp holding the folded over shirt fabric layers 26 adjacent the arm. Furthermore, the cuff adapts to arms of different sizes as illustrated in FIG. 8, for example. The corners of the cuff member 30 are rounded to prevent any snagging on fabric of the shirt sleeves.

Figure 5:
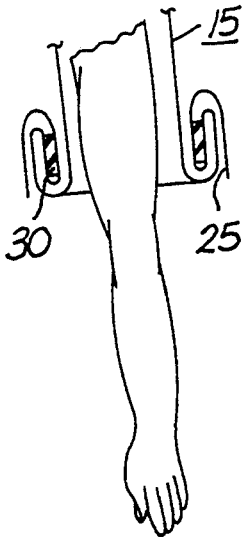
FIG. 5 is a fragmental sketch showing the uppermost flap turned down outside the cuff band.

In the mounted position of FIG. 4, the band 30 is of substantially the same height as the lower fold layers (26) of the fabric. The end flap 25 is slightly longer so that it may be folded outermost over the cuff member and lower folds as shown in FIG. 5. It is noted that when the flap member 25 is folded downwardly to cover the cuff stiffener and shaper member 30, it has its decorative outside surface out, so that the end result becomes a short shirt sleeve 35 illustrated in FIG. 6. In this preferred embodiment, the split cylinder cuff band 30 retains the cuff neatly so that it stays in place during exercise and work. Other foldover patterns could be employed within the scope of this invention.

Having therefore advanced the state of the art with novel structure and methods for temporarily and reversibly converting long sleeve shirts to short sleeve shirts, those novel features illustrative of the nature and spirit of the invention are set forth with particularity in the following claims.

I claim:

1. The method of temporarily converting a long sleeved shirt into a short sleeved shirt, comprising in combination the steps of:

folding upwardly a long shirt sleeve with fabric inside surface-out to form a folded section to be worn on wearer's arm above an elbow, encircling a lower portion of the upwardly folded shirt sleeve section with a substantially cylindrical unattached cuff band stiffener to be positioned on the arm above the elbow, and folding downwardly an uppermost portion of the upwardly folded shirt sleeve section to cover the cuff band with the outside surface of the shirt sleeve outermost to thereby provide a lower shirt cuff portion for residing above the elbow with the outer surface of the shirt sleeve visibly displayed.

2. The method of claim 1 further comprising the step of forming the cuff band of an elastic plastic film material with an axial slit through the cylindrical shape to provide an elastic clamping member of a dimension that encompasses and hugs arms of different size.

3. The method of claim 2 further comprising the step of elastically clamping the cylindrical cuff band about the arm to retain the shirt cuff at a designated position above the elbow.

4. The method of claim 1 further comprising the step of producing said substantially cylindrical cuff band stiffener of a high impact, heat resistant, plastic film having a diameter of the order of four inches (10.2 cm), a height of the order of three inches (7.6 cm), and a thickness of the order of 0.030 inches (0.76 mm).

* * * * *